US010633239B2

(12) United States Patent
Herlin

(10) Patent No.: US 10,633,239 B2
(45) **Date of Patent: *Apr. 28, 2020**

(54) COMMUNICATION SYSTEM FOR MONITORING BEER KEGS

(71) Applicant: Gregory W Herlin, Kirkland, WA (US)

(72) Inventor: Gregory W Herlin, Kirkland, WA (US)

(73) Assignee: Shyft Advanced Industries, Kirkland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/526,849

(22) Filed: Jul. 30, 2019

(65) Prior Publication Data

US 2019/0352166 A1 Nov. 21, 2019

Related U.S. Application Data

(63) Continuation of application No. 15/130,179, filed on Apr. 15, 2016, now Pat. No. 10,384,924.

(51) Int. Cl.
*G08B 23/00* (2006.01)
*B67D 1/08* (2006.01)

(52) U.S. Cl.
CPC ..... *B67D 1/0878* (2013.01); *B67D 1/0801* (2013.01); *B67D 1/0888* (2013.01); *B67D 2001/0811* (2013.01); *B67D 2001/0822* (2013.01)

(58) Field of Classification Search
CPC .. B67D 1/0878; B67D 1/0801; B67D 1/0888; B67D 2001/0811; B67D 2001/0822
See application file for complete search history.

(56) References Cited

U.S. PATENT DOCUMENTS 7,855,637 B2 * 12/2010 Forster ..... B65D 7/045 340/539.1
2012/0059513 A1 * 3/2012 Perkins ..... B67D 1/0406 700/244
2015/0109143 A1 * 4/2015 Hershberger ..... G06Q 10/08 340/870.07

* cited by examiner

*Primary Examiner* — Dhaval V Patel
(74) *Attorney, Agent, or Firm* — Jensen & Puntigam, P.S.; Clark A. Puntigam

(57) ABSTRACT

A beer keg is identified to a brewery which fills the keg and identifies the date on which the beer keg is filled. A sensor system is attachable to or built in the beer keg, including a temperature sensor for the beer and a location sensor for the keg. The sensor information is transmitted to data storage associated with the brewery. Information is provided directly between the brewery and the sensor system on the keg.

4 Claims, 4 Drawing Sheets

COMMUNICATION SYSTEM FOR MONITORING BEER KEGS

TECHNICAL FIELD

This invention relates generally to beer kegs and more specifically to a system for monitoring one or more characteristics of the use and/or contents of beer kegs.

BACKGROUND OF THE INVENTION

Draft beer is typically provided in beer kegs, with the kegs having a typical volume in the range of 15.5 gallons. However, it has been difficult, if not impossible, heretofore, to ensure proper handling of draft beer kegs to ensure quality of the beer. Temperature, age and light are the highest risk factors that affect quality of draft beer. The lack of an ability to provide quality control and monitoring produces an economic loss to the owner. Estimates indicate that the lack of control over handling results in a 4-7%, or even more, reduction in sales. Poor handling includes exposure to even moderate heat as well as excessive time in storage, even storage which is temperature controlled. Further, even with refrigerated trains and trucks, there is no automated system to ensure overall proper handling of the individual kegs. While most kegs do a suitable job for protecting beer from the effects of light, other factors such as temperatures to which the keg has been exposed and age of the beer significantly affect the quality of the beer over its lifetime in a keg.

Once a filled beer keg leaves the producer, i.e. the brewer, there is no reliable way for the brewer to know the conditions the keg encounters, or whether it was ever subjected to conditions which could affect quality. Further, there is no verification of the travel of the individual beer keg and no knowledge of the location of a keg. Typically, many kegs go missing, and are never returned to the source. It has been estimated that in excess of 20 million kegs are used each year with 500,00 kegs lost and 100 million dollars in economic loss.

Accordingly, it would be desirable to have a monitoring system which can correct one or more of the disadvantages encountered by beer kegs during use thereof.

SUMMARY OF THE INVENTION

Accordingly, disclosed herein is a communication system for monitoring the use of beer kegs and the beer contained therein, for a brewery which in operation fills the kegs with beer and communicates directly with the kegs, comprising: a sensor system, which includes a processor and temporary data storage, attachable to a beer keg which when filled moves between the brewery and a selected destination; a two-way information communication link which directly connects the brewery and the sensor system attached to the keg concerning filling of the keg with beer by the brewery and the status of the keg and the beer therein during transportation of a filled keg to a destination, including providing information to the brewery from the sensor system that the keg has arrived at to brewery for fillings, wherein information provided by the brewery to the sensor system includes confirmation to the sensor system that the keg is ready to be filled by the brewery following cleaning of the keg and otherwise making the keg ready to be filled by the brewery, and wherein information acquired by the sensor system in operation is provided to said processor therein and from there to said temporary data storage and then to the brewery; wherein the information acquired by the sensor system includes the temperature of the beer in the keg and the location of the keg, as the keg moves from the brewery to the destination, wherein the sensor system provides an alert to the brewery when the temperature of the beer is out of a standard temperature range; and wherein all information acquired by the sensor system is uploaded directly from the temporary data storage in the sensor system to the data storage associated with the brewery over the communication network and wherein all information provided by the brewery to the sensor system is provided directly to the processor therein over the communication link.

BEST MODE FOR CARRYING OUT THE INVENTION

Figure 1:
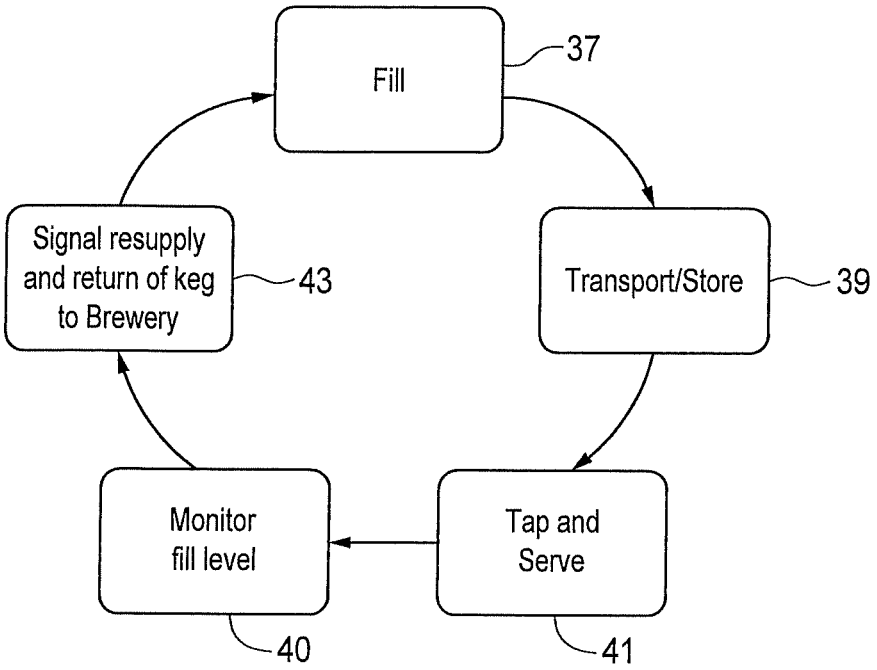
FIG. 1 is a block diagram showing the sequence of use of the present beer keg system.
Figure 2:
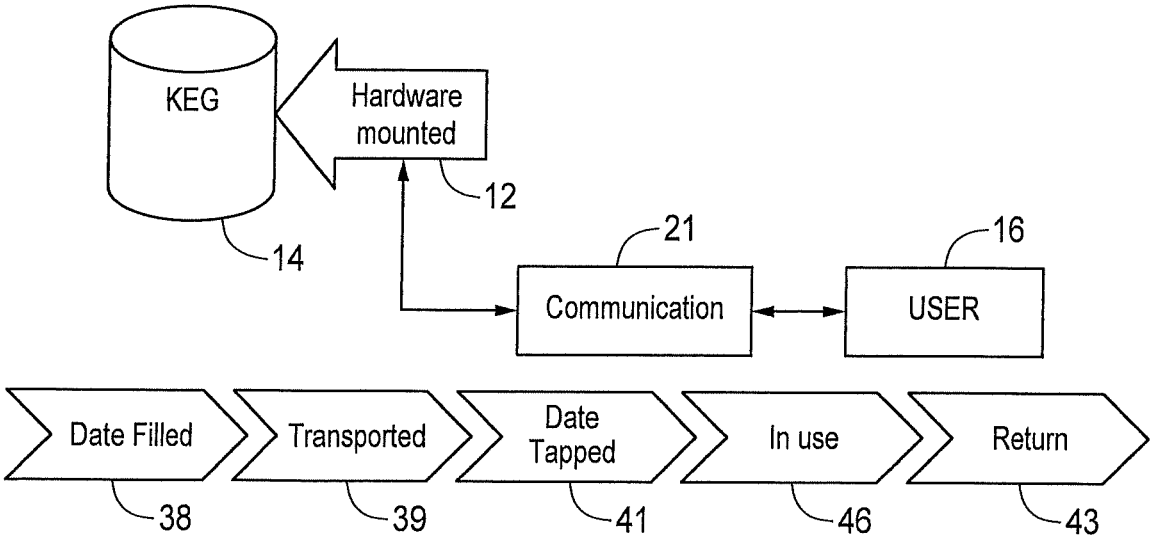
FIG. 2 is a more detailed diagram illustrating the hardware monitoring of the present system and the tracking of the life of a single filling of the beer keg.

Referring to FIGS. 1-5, the present system includes one or more sensors 12 attached to a beer keg 14 by a user/proprietor, typically a brewery or other organization which fills the keg with beer. The beer could be conventional, including well known beer brands, or what are known as craft beers, brewed in smaller quantities. The sensors will be part of a device 15, shown in FIG. 4 in combination with an external user data center 16, the device 15 including a communication capability, software and data storage 17, as well as a processor 19. FIGS. 5A and 5B show two embodiments for the monitoring device, one on top of the keg, at 13 adjacent the fill port 14A and the other along a portion of the periphery of the top of the keg, at 13. The processor will typically include a battery 20 and/or charging unit, (plug) 22. The user represented at 16 (FIG. 2) will initially signal the hardware sensors 12 that the beer keg 14 is clean and ready for filling. The user will have previously cleaned the keg and otherwise made it ready for filling. Communication can be accomplished via a wired or wireless connection 21 to the device. The assembly is turned on and remains on. Communication is established with the network. A systems check confirms that the sensors have power and sufficient charge to begin their monitoring function. A signal is sent back to the user 16 via the communication link 21. The sensors establish a current time and date, fill level, temperature, and the location of the keg. This information is recorded in temporary memory 17 in the device. The keg is identified by a serial number assigned to it. Communication is provided between a processor 19 and the sensors 12 and the external data center 30 via a communication link GSM (cellular) system 32, WIFI 34 or Bluetooth 36 or others. When the keg is indentified and acknowledged by the processor 19, the keg is filled, as indicated at 37. The date and time of filling is recorded, at 38. The filled keg is then stored and/or transported, at 39. The storage can be accomplished by various entities, including the brewery itself, a distributor or a retailer. Readings of time, temperature and location are then taken by the sensor unit at selected intervals, such as hourly, and recorded in temporary data storage 17. This, however, can vary. When the keg reaches its destination, it is tapped and the beer served, at 41, and in use, 46 from that point.

The processor and more particularly the software in the processor, checks regularly for receipt of data from the sensors, which will typically include temperature 45, fill level (volume) 47 and location 49. Typically, the sensor readings are recorded in the data storage 17 on an hourly basis but are then transmitted to the external data control center 30 daily, but this can be changed by the user. An alarm can be transmitted if no data is recorded by the data center. Alarms can be set for temperature variations from a standard temperature range during transport or use of the keg including over temperature and under temperature. It is important that the beer not be exposed to temperatures outside of the preselected range, which may vary depending on the beer. If data transmission is for some reason temporarily interrupted i.e. not fulfilling the daily reporting requirements, communication begins with the last confirmed communication, at least 24 hours of data. The location of the keg (longitude and latitude) can be provided as well. Location can be provided to the user at the data center on a map, for instance. Volume can be recorded by a flow sensor or force sensor, at the bottom of the keg, as shown at 48 in FIG. 5.

When the volume measured or determined from the force sensor reaches a certain low level, a notice can be sent to the user advising them of the volume remaining. The keg can then be retrieved or sent back to the user from the last location, to ensure freshness. Further, a resupply notice can be sent to the user providing an indication that a resupply is necessary. Contact can then be made with the proprietor or other user at the location relative to a providing new keg. The original keg is then returned to the brewery for cleaning and reuse, at 43.

Figure 3:
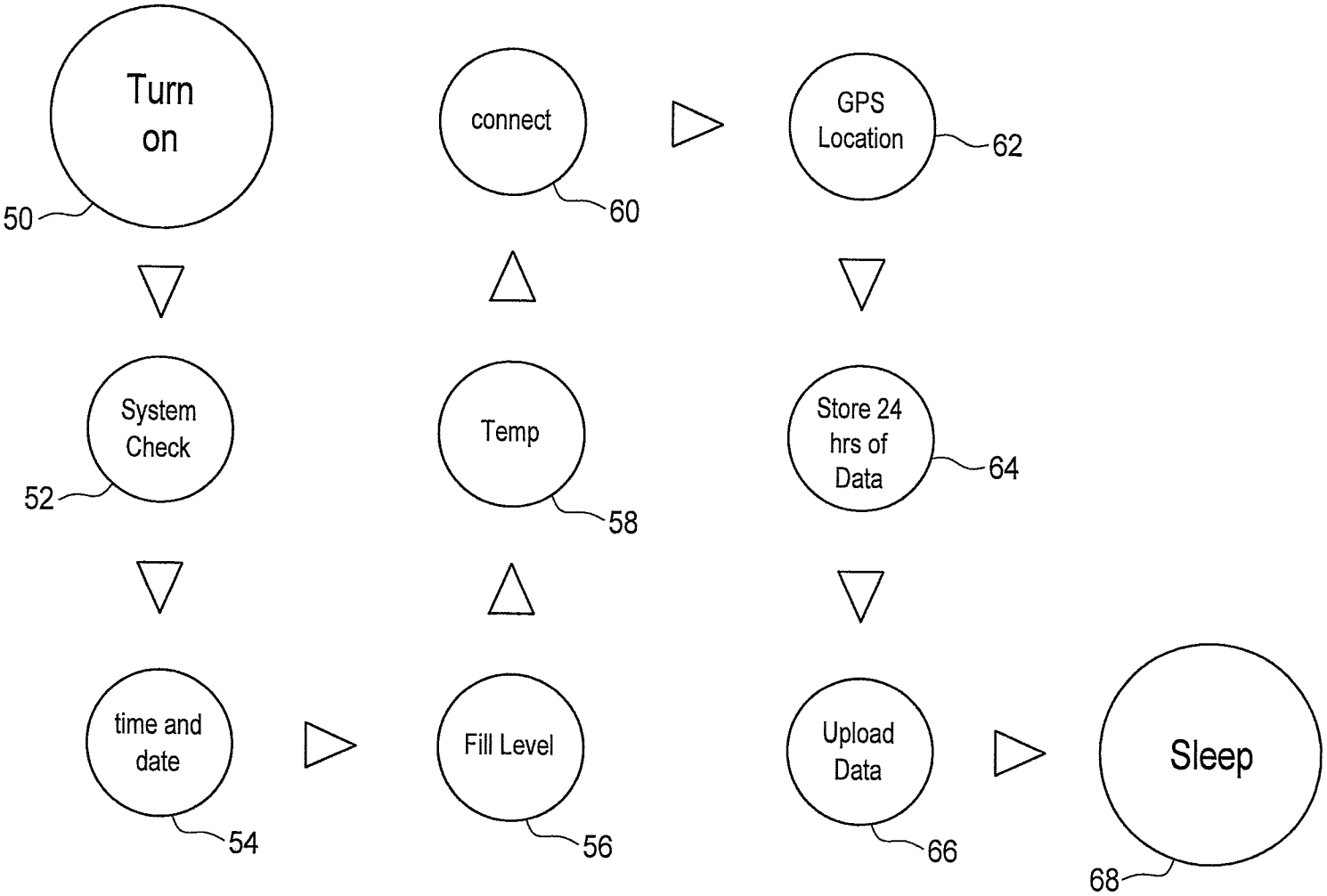
FIG. 3 is a diagram showing the flow of information from the hardware elements to the data collection and processing center.
Figure 4:
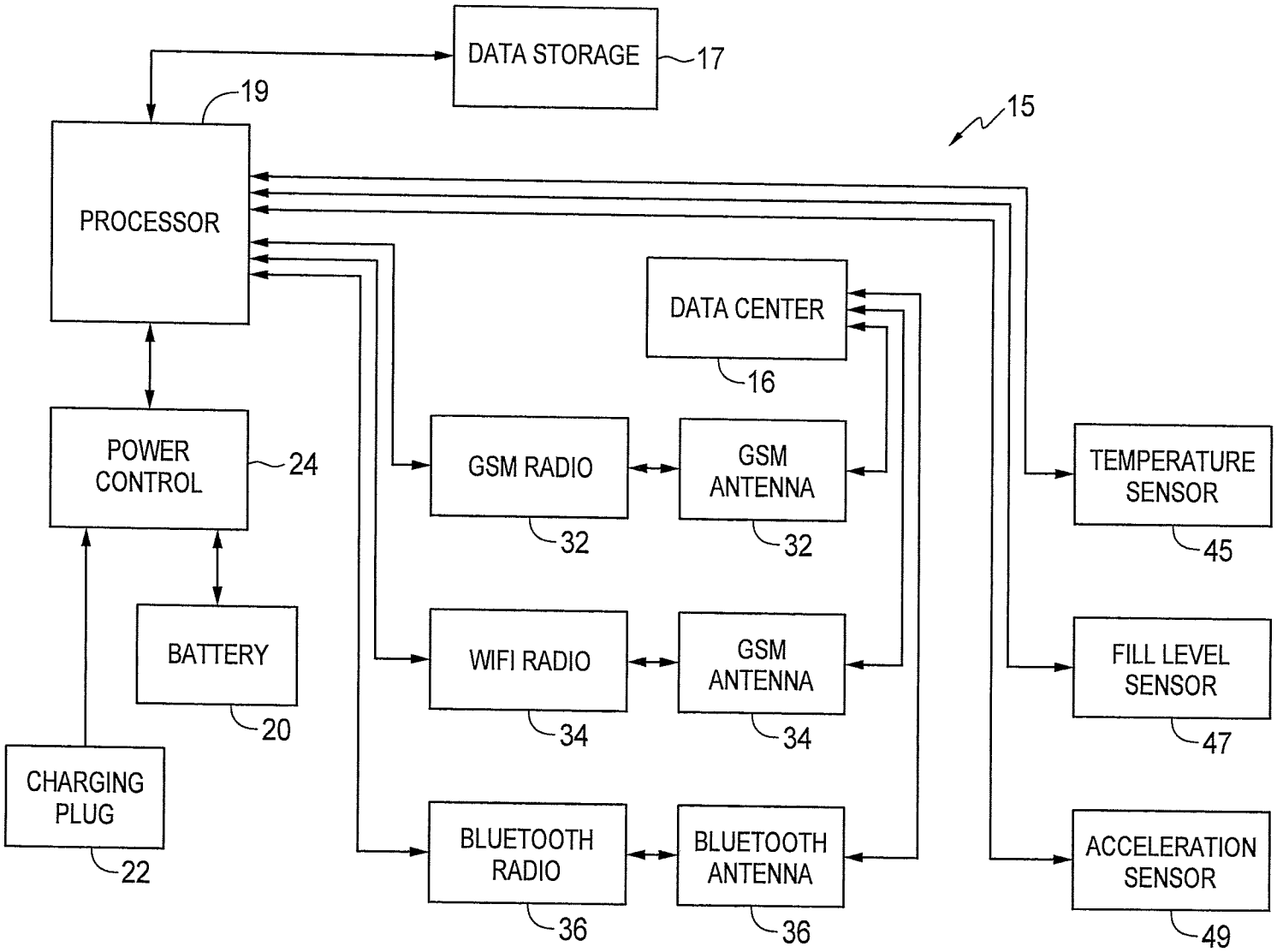
FIG. 4 is a block diagram showing the operating hardware of the present system.
Figure 5A:
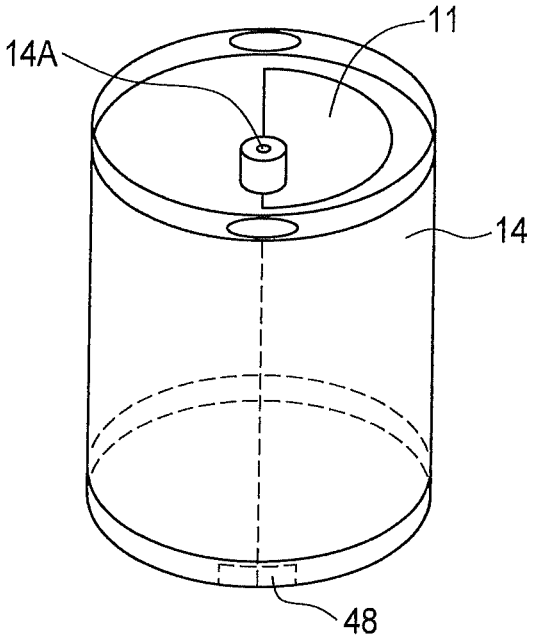
FIGS. 5A and 5B are more detailed views of the sensor/beer keg connection arrangement.
Figure 5B:
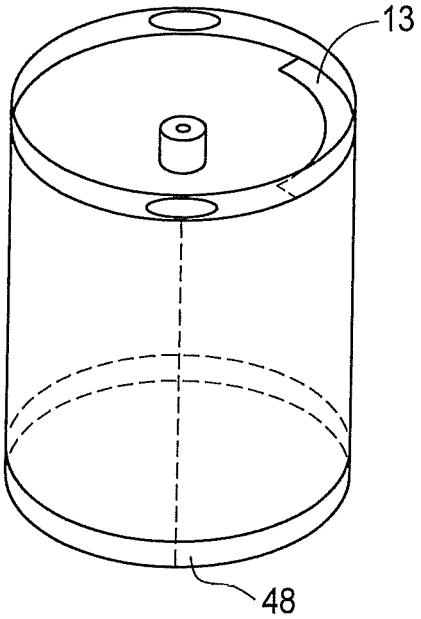

FIG. 3 shows the cycle of use of the present invention. The system is turned on, at 50, and remains on, and a system check preformed, at 52. The time and date of fill is recorded, at 54. The fill level and the temperature are constantly monitored, at 56 and 58, and connection is made with the on-keg processor, at 60, with GPS information at 62, and 24 hours of data stored, at 64. The data is then uploaded from temporary storage at 66 to the external data center. The system then goes into a sleep mode, at 68, until it is again time to take sensor readings, at intervals predetermined by the user.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A communication system for monitoring the use of beer kegs and the beer contained therein, for a brewery which in operation fills the kegs with beer and communicates directly with the kegs, comprising:

a sensor system, which includes a processor and temporary data storage, attachable to a beer keg which when filled moves between the brewery and a selected destination;

a two-way information communication link which directly connects the brewery and the sensor system attached to the keg concerning filling of the keg with beer by the brewery and the status of the keg and the beer therein during transportation of a filled keg to a destination, including providing information to the brewery from the sensor system that the keg has arrived at to brewery for fillings, wherein information provided by the brewery to the sensor system includes confirmation to the sensor system that the keg is ready to be filled by the brewery following cleaning of the keg and otherwise making the keg ready to be filled by the brewery, and wherein information acquired by the sensor system in operation is provided to said processor therein and from there to said temporary data storage and then to the brewery;

wherein the information acquired by the sensor system includes the temperature of the beer in the keg and the location of the keg, as the keg moves from the brewery to the destination, wherein the sensor system provides an alert to the brewery when the temperature of the beer is out of a standard temperature range; and wherein all information acquired by the sensor system is uploaded directly from the temporary data storage in the sensor system to data storage associated with the brewery over the communication network and wherein all information provided by the brewery to the sensor system is provided directly to the processor therein over the communication link.

2. The communication system of claim 1, wherein the system provides a notice of resupply to a selected party when the volume of beer in the keg has reached a selected level.

3. The communication system of claim 1, wherein the sensor system is located along a portion of a rim of the beer keg.

4. The communication system of claim 1, including a force sensor location at the bottom of the beer keg.

* * * * *